US008191521B2

(12) United States Patent
Kandolf et al.

(10) Patent No.: US 8,191,521 B2
(45) Date of Patent: Jun. 5, 2012

(54) CAMSHAFT PHASE ADJUSTER FOR CONCENTRIC CAMSHAFTS

(75) Inventors: Michael Kandolf, Saint Clair, MI (US); Jesse Myers, Waterford, MI (US); Greg Muller, Troy, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 255 days.

(21) Appl. No.: 12/694,727

(22) Filed: Jan. 27, 2010

(65) Prior Publication Data

US 2010/0186700 A1 Jul. 29, 2010

Related U.S. Application Data

(60) Provisional application No. 61/147,919, filed on Jan. 28, 2009.

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17; 464/1, 2, 160
See application file for complete search history.

(56) References Cited

U.S. PATENT DOCUMENTS 7,614,370 B2 * 11/2009 Fischer et al. ..... 123/90.15

* cited by examiner

*Primary Examiner* — Ching Chang
(74) *Attorney, Agent, or Firm* — Lucas & Mercanti, LLP; Klaus P. Stoffel

(57) ABSTRACT

The camshaft phaser is affixed to one end of a concentric camshaft. The phaser is a vane-type camshaft phaser where the stator and the sprocket are fixed to the outer camshaft and the trigger wheel and rotor are fixed to the inner camshaft. The torsion spring is mounted on an outer wall of the stator, between the stator and the trigger wheel. The phaser is a compact unit with a high degree of reliability.

5 Claims, 7 Drawing Sheets

CAMSHAFT PHASE ADJUSTER FOR CONCENTRIC CAMSHAFTS

FIELD OF THE INVENTION

This invention relates to camshaft adjusters and more particularly to camshaft adjusters or phasers which are used with concentric camshafts having an inner and an outer camshaft.

BACKGROUND OF THE INVENTION

Concentric camshafts have an inner and an outer camshaft wherein the inner camshaft is used for one set of valves and the outer camshaft is used for another set of valves on an internal combustion engine. Camshaft adjusters or phasers for concentric camshafts are conventional star-type camshaft phase adjusters attached to the outer camshaft. The phaser is used to phase the inner camshaft with respect to the outer camshaft. This means that the phaser can accomplish intake phasing based on the camshaft design and the engine architecture. When attaching the phaser to a concentric camshaft, it is important that the chain load (loads in the direction of the camshaft directly down towards the crankshaft) be transmitted from the phaser, into the more structure-rigid outer camshaft. If the load is supported principally by the inner camshaft, bending will occur on the inner shaft which will cause the inner and outer camshafts to bind to one another and prevent intake versus exhaust valve timing adjustments.

Conventional torsion springs are used to assist the phasing of the inner camshaft to the advanced position from the parked position of retard. Conventional torsion springs used on phasers for concentric twin camshafts are mounted externally to the phaser with one end hooked to the sprocket of the camshaft and the other end is hooked to the camshaft via a tab on the trigger wheel.

OBJECTS OF THE INVENTION

It is the object of the invention to provide a robust phaser which will allow for the phasing of the intake lobes of a camshaft on a single camshaft when assembled to the outer shaft of a concentric camshaft.

It is further the object of the present invention that the phaser is able to be installed as a pre-assembled unit. This allows for a low-risk of internal contamination when installed in the engine assembly plant and allows for an assembly process which is similar to the assembly process of a camshaft sprocket, minimizing the assembly complexity at the engine assembly plant.

It is further the object of the present invention to provide a phaser which has serviceability similar to that of conventional phaser units used on conventional camshafts, i.e. not concentric camshafts.

It is also the object of the present invention to allow the camshaft phaser to be removed as a unit and reinstalled or replaced as a unit. This prevents the complexity of service in the field which would involve reassembly of the phaser unit if it were not a preassembled unit.

It is further the object of the present invention that the phasers have a compact design similar to conventional vane-type phasers.

It is further the object of the present invention that the cost of the phaser unit is similar to conventional phasers and that they have the reliability of conventional phaser units.

It is further the object of the present invention to provide such a phaser with a force to assist the phaser in phasing to the advanced position, overcoming intake cam torsionals.

These and other objects of the invention may be more fully understood by reference to the following description.

SUMMARY OF THE INVENTION

The objects of the present invention are obtained by use of a camshaft adjusting device, phaser, as described herein.

The phaser of the present invention is a vane-type camshaft phaser having a reliable phaser design. The main components of the phaser of the present invention employs a sprocket wheel, a stator, a rotor, a front sealing cover, a torsion spring, a trigger wheel, and a center bolt. The phaser mates to the concentric camshaft allowing for shifts of intake lobes with respect to exhaust lobes using a single concentric camshaft. In-cam in-block engines as well as SOHC engines are provided with the advantage of phasing intake and exhaust lobe separately. Therefore, the device of the present invention has advantages gained in engine idle stability and power gains available in a single camshaft engine similar to those advantages which were only available heretofore in DOHC engines with multiple cam phasers.

In the present invention, the phaser is a single acting phaser which controls only the inner camshaft. The sprocket is connected directly to the outer camshaft while the rotor phases the inner camshaft.

The torsion spring is wound directly onto a radial outer wall of the stator, in between the stator and the trigger wheel. Thus, the torsion spring is internal to the phaser, not external.

Specifically, in the design of the present invention, the sprocket wheel is fixed to the outer camshaft and the stator is fixed to the sprocket wheel. The rotor is fixed to the inner camshaft through a center bolt and the trigger wheel is fixed to the rotor.

Broadly, the present invention can be defined as follows:

A camshaft adjusting device for a concentric camshaft comprising:

- a sprocket wheel fixable to an outer camshaft at one end of a concentric camshaft;
- a stator fixed to the sprocket wheel and movable with the sprocket wheel, the stator having a circular internal hollow, one or more chambers extending radially outward from the hollow, each one of the chambers having an advance oil port and a retard oil port;
- a rotor fixable to an inner camshaft at the one end of the concentric camshaft, the rotor having a circular inner portion rotationally and concentrically positioned in the hollow, vanes extending radially outward from the inner portion, one vane positioned and movable in each one of the chambers,
- a trigger wheel concentric with and fixed to the rotor and positioned outside of the stator;
- a torsion spring, one end of the spring fixed to the sprocket and the other end fixed to the trigger wheel; and
- a center bolt which is fixable to the inner camshaft to fix the rotor to the inner camshaft.

Preferably, the center bolt fixes the trigger wheel to the rotor.

Preferably, the rotor is a single rotor.

Suitably, a front sealing cover is fixed to an axial front wall of the stator and the sprocket wheel is fixed to an axial back wall of the stator so as to seal the chambers.

Suitably, the torsion spring is a circular torsion spring mounted concentrically on a radial outside wall of the stator, between the stator and the trigger wheel, one end of the spring is fixed to the sprocket wheel and the other end of the spring is fixed to the trigger wheel.

These and other aspects of the present invention may be more readily understood by reference to one or more of the following drawings:

DETAILED DESCRIPTION OF THE INVENTION

Figure 1:
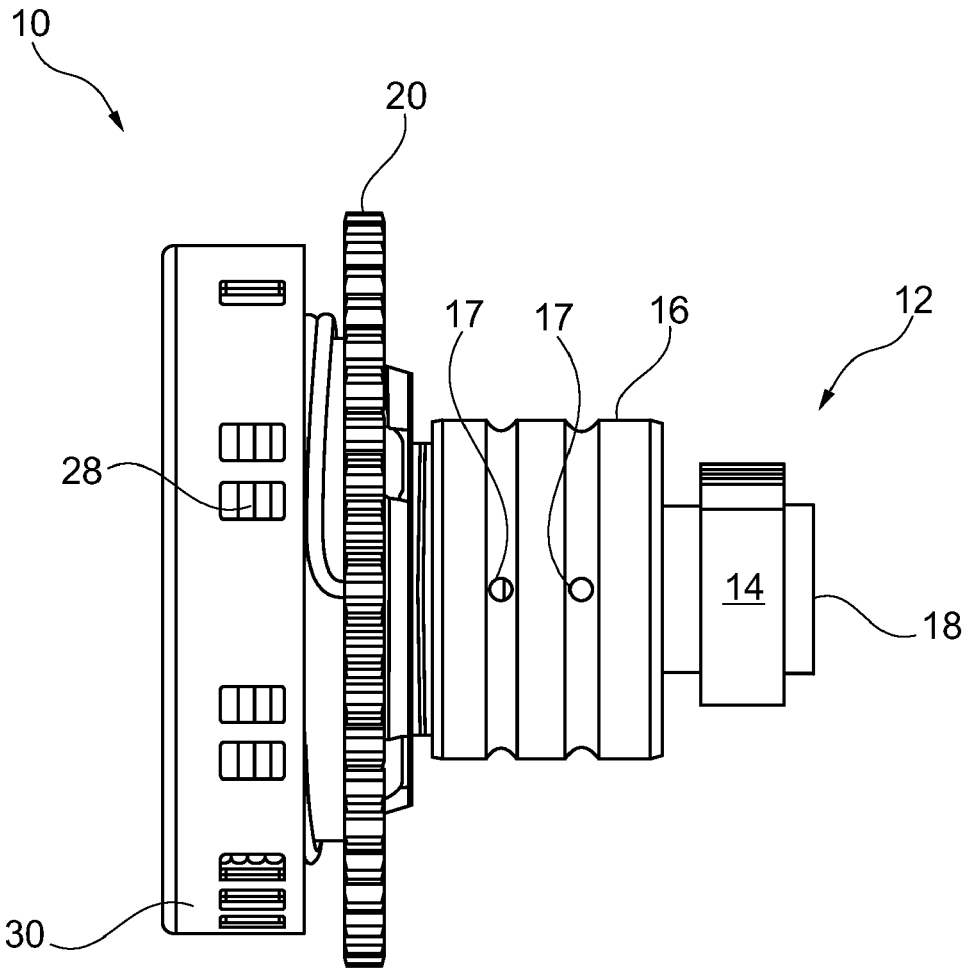
FIG. 1 is a side view of the cam phase adjuster installed on the outside of one end of a concentric camshaft.

FIG. 1 illustrates the side view of phaser 10 on concentric camshaft 12 having cams 14 with an outer camshaft 16 and an inner camshaft 18. Oil inlets 17 are illustrated on outer camshaft 16. Oil inlets 17 receive oil in a conventional manner and pass it on to the inner portions of phaser 10 as described in more detail below.

Phaser 10 has sprocket wheel 20, stator 22, rotor 24, front sealing cover 26, torsion spring 28, trigger wheel 30 and center bolt 32.

Figure 2:
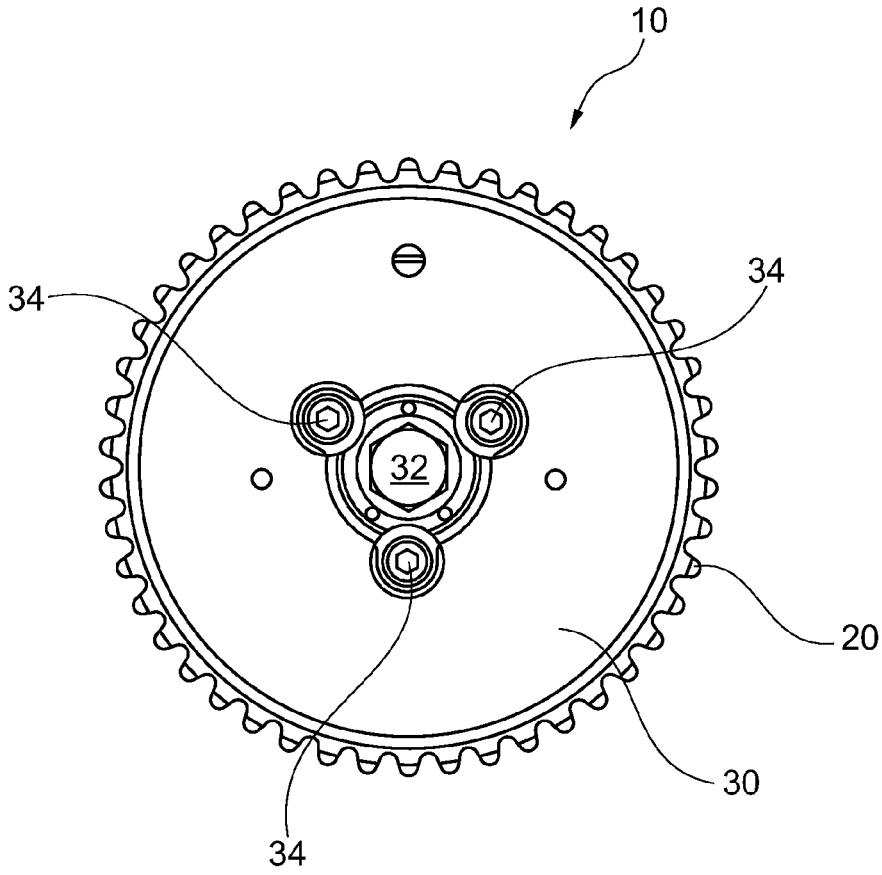
FIG. 2 illustrates the front view of the phaser of FIG. 1.

FIG. 2 illustrates the front of phaser 10 and shows center bolt 32 connected through the center of phaser 10. Bolts 34 connect sprocket 20 to outer cam shaft 16.

Figure 3:
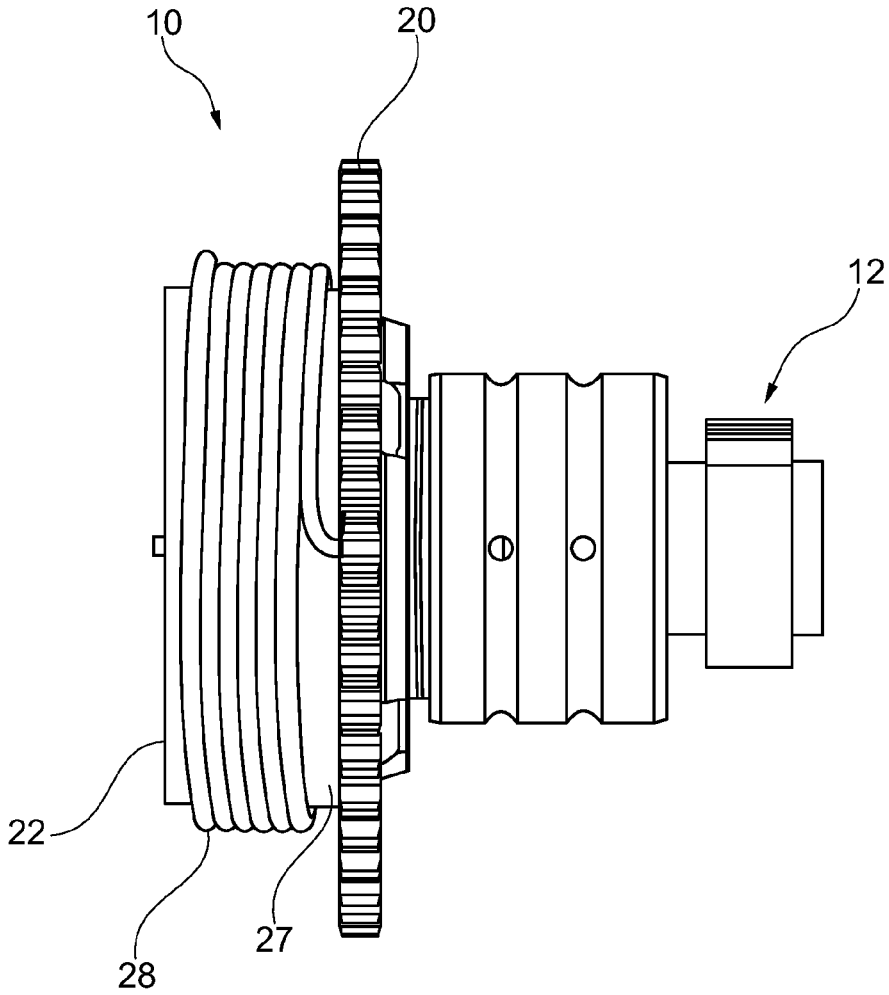
FIG. 3 illustrates the camshaft as a phase adjuster of FIG. 1 with the trigger wheel removed.

FIG. 3 illustrates phaser 10 with trigger wheel 30 removed. Spring 28 is wound around the radial outer wall 27 of stator 22.

Figure 4:
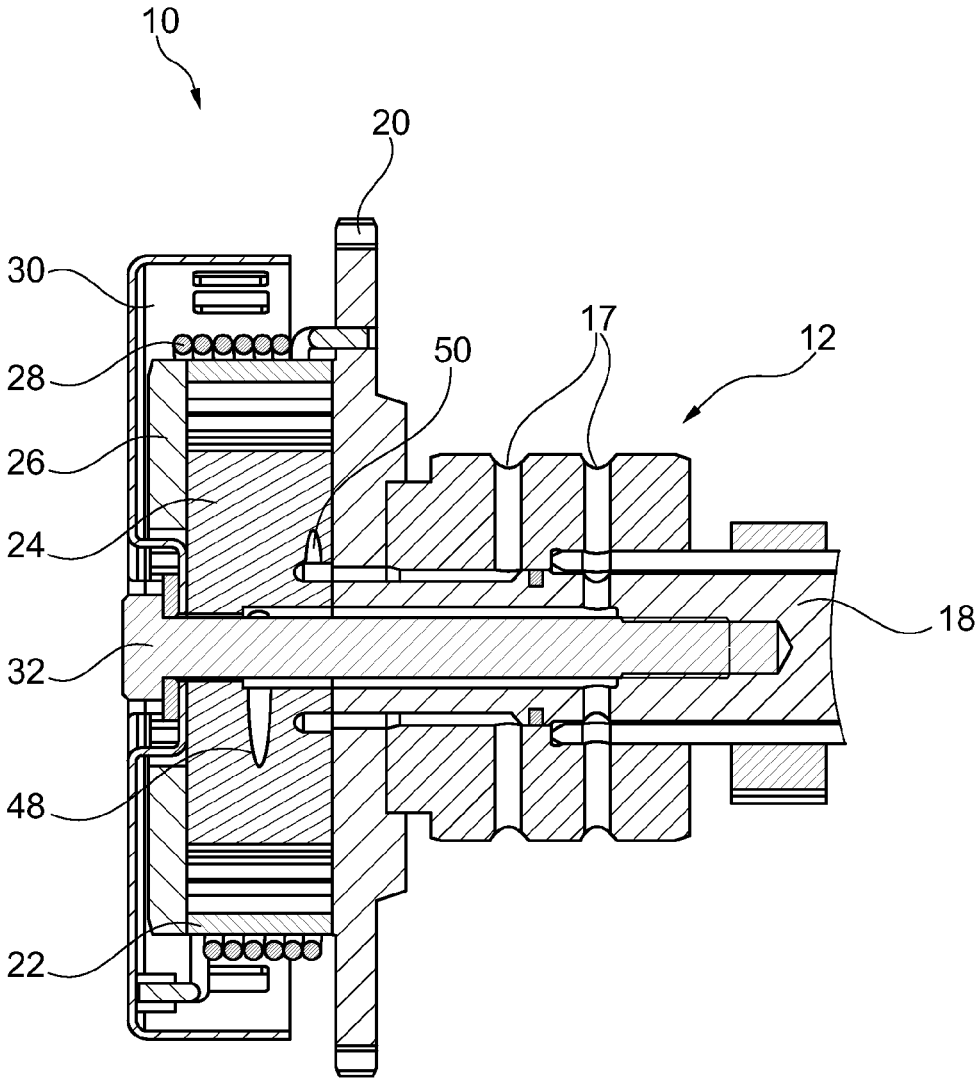
FIG. 4 illustrates a cross-sectional view of the phaser of FIG. 1.

FIG. 4 illustrates phaser 10 in cross-section. As can be seen, center bolt 32 extends into and connects with inner camshaft 18.

Figure 5:
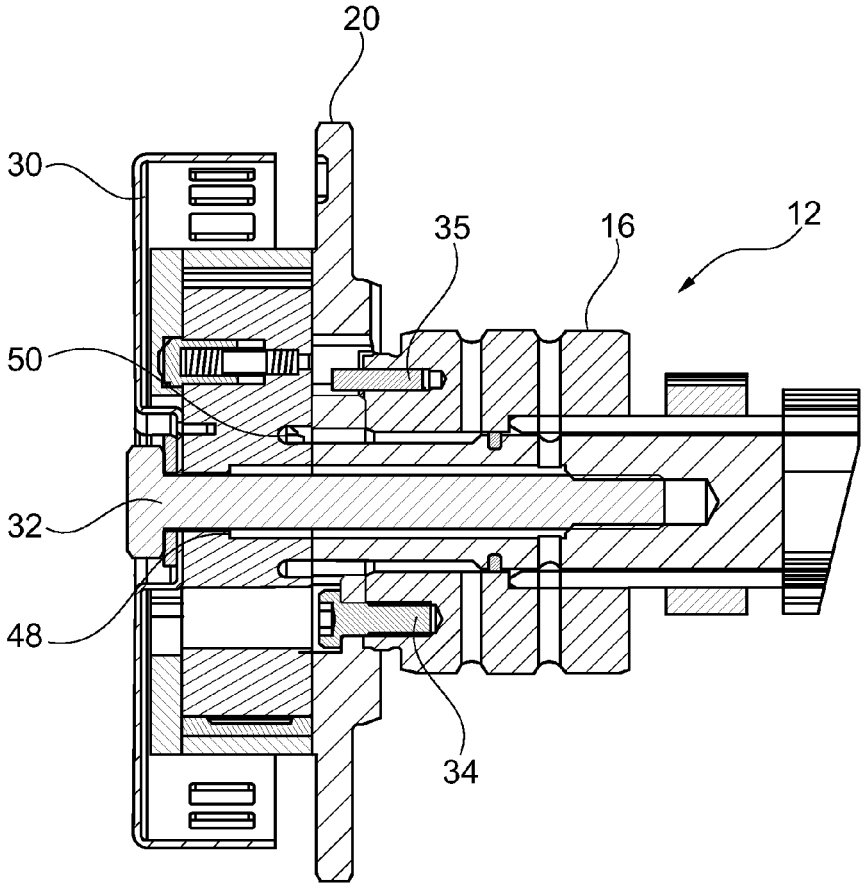
FIG. 5 illustrates a cross-sectional view illustrating the various bolts used to connect the parts of the phaser.

FIG. 5 illustrates the connection of bolts 34 to sprocket wheel 20 and outer camshaft 16. Pin 35 provides correct timing of outer camshaft 16 to sprocket 20.

Figure 6:
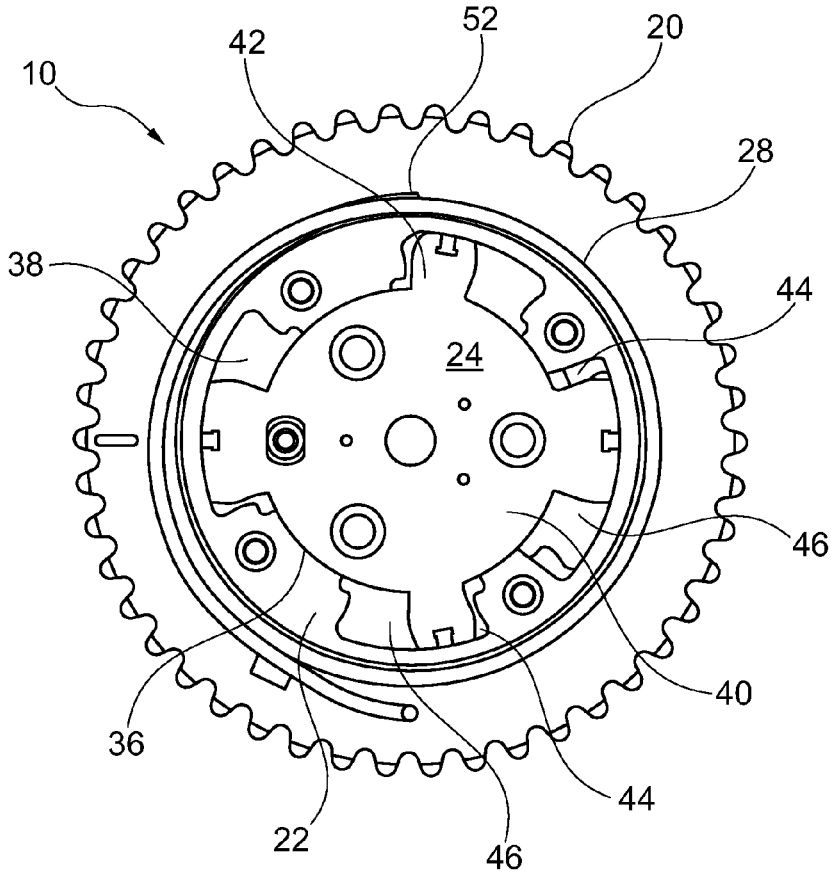
FIG. 6 illustrates the internal workings of the stator and the rotor.

FIG. 6 illustrates a front view of phaser 10 with trigger wheel 10 and front seal 26 removed.

Stator 22 is illustrated having hollow 36 and chamber 38 extending radially out therefrom. In hollow 36 is circular inner portion 40 of rotor 24. Extending radially outward from inner portion 40 are vanes 42. Vanes 42 are located in chamber 38 and divide chamber 38 into oil advance chamber 44 and oil retard chamber 46.

Figure 7:
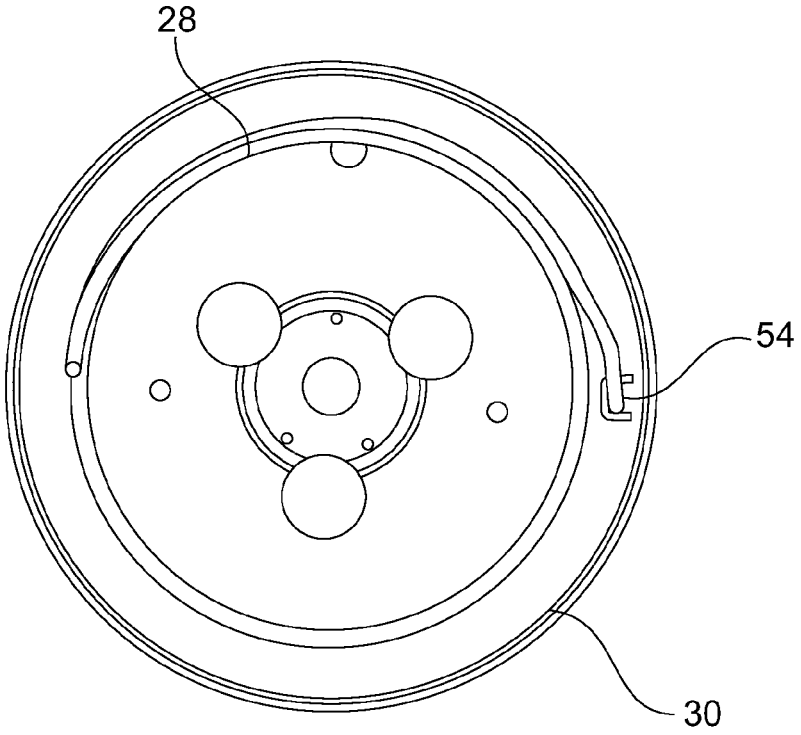
FIG. 7 illustrates the torsion spring mounted inside the trigger wheel.

Each oil advance chamber 44 is connected to oil advance port 48 while oil retard chamber 46 is connected to oil retard port 50. Oil advance port 48 and oil retard port 50 include channels for connecting ports 48 and 50 to oil inlets 17 on outer camshaft 16. The control of oil through inlets 17, ports 48 and 50, and chambers 44 and 46 so as to advance for retard vanes 42 is operated in a conventional manner using conventional oil pumping equipment. Also as illustrated in FIG. 6, torsion spring end 52 connects to sprocket 20. End 54 of torsion spring 28 connects to the inside wall of trigger wheel 30 as illustrated in FIG. 7. FIG. 7 illustrates the inside of trigger wheel 30.

Center bolt 32 fixes rotor 24 to inner shaft 18. Trigger wheel 30 is fixed to rotor 24 so the trigger wheel and rotor move together. Sprocket wheel 20 is fixed to outer cam shaft 16 by bolts 34 and stator 22 is fixed to sprocket wheel 20. Thus, stator 22 and sprocket wheel 20 move together.

REFERENCE CHARACTERS

10 phaser
12 concentric camshaft
14 cams
16 outer camshaft
17 oil inlet
18 inner camshaft
20 sprocket wheel
22 stator
24 rotor
26 front sealing cover
28 torsion spring
30 trigger wheel
32 center bolt
34 bolt—sprocket to outer camshaft
35 pin
36 hollow
37 radial outer wall
38 chambers
40 circular inner portion
42 vanes
44 oil advance chamber
46 oil retard chamber
48 oil advance port
50 oil retard port
52 torsion spring end sprocket wheel
54 torsion spring end trigger wheel

The invention claimed is:

1. A camshaft adjusting device for a concentric camshaft comprising:

a sprocket wheel fixable to an outer camshaft at one end of a concentric camshaft;

a stator fixed to the sprocket wheel and movable with the sprocket wheel, the stator having a circular internal hollow, one or more chambers extending radially outward from the circular internal hollow, each one of the chambers having an advance oil port and a retard oil port;

a rotor fixable to an inner camshaft at the one end of the concentric camshaft, the rotor having a circular inner portion rotationally and concentrically positioned in the circular internal hollow, vanes extending radially outward from the inner portion, one vane positioned and movable in each one of the chambers, a trigger wheel concentric with and fixed to the rotor and positioned outside of the stator;

a torsion spring, one end of the torsion spring fixed to the sprocket wheel and the other end fixed to the trigger wheel; and a center bolt which is fixable to the inner camshaft and fixes the rotor onto the inner camshaft.

2. The device of claim 1, wherein the center bolt fixes the trigger wheel to the rotor.

3. The device of claim 1, wherein the rotor is a single rotor.

4. The device of claim 1, further comprising a front sealing cover is fixed to an axial front wall of the stator and the sprocket wheel is fixed to an axial back wall of the stator so as to seal the chambers.

5. The device of claim 1, wherein the torsion spring is a circular torsion spring mounted concentrically on a radial outside wall of the stator, between the stator and the trigger wheel, one end of the circular torsion spring fixed to the sprocket wheel and the other end of the circular torsion spring fixed to the trigger wheel.

* * * * *